US008154461B2

(12) United States Patent
Chang

(10) Patent No.: US 8,154,461 B2
(45) Date of Patent: Apr. 10, 2012

(54) MULTI-DIRECTIONAL PANEL ANTENNA

(75) Inventor: Ming-Wen Chang, Hong Kong (HK)

(73) Assignee: San Wen (H.K.) International Co., Ltd., Kowloon (HK)

( * ) Notice: Subject to any disclaimer, the term of this patent is extended or adjusted under 35 U.S.C. 154(b) by 426 days.

(21) Appl. No.: 12/512,051

(22) Filed: Jul. 30, 2009

(65) Prior Publication Data

US 2011/0025578 A1 Feb. 3, 2011

(51) Int. Cl.
*H01Q 1/24* (2006.01)

(52) U.S. Cl. ..... 343/702; 343/700 MS

(58) Field of Classification Search ..... 343/700 MS, 343/702, 860

See application file for complete search history.

(56) References Cited

U.S. PATENT DOCUMENTS 8,059,046 B2 * 11/2011 Nysen ..... 343/725

* cited by examiner

*Primary Examiner* — Tan Ho

(74) *Attorney, Agent, or Firm* — Leong C. Lei

(57) ABSTRACT

A multi-directional panel antenna is provided for the reception of TV broadcast VHF and UHF signals. The panel antenna's circuit board has its current path substantially covers the surface of the circuit board so as to produce multi-directional reception patterns. An iron-core winding is configured at a feed-in terminal of the panel antenna for impedance matching and signal concentration. The panel antenna also uses air to reduce dielectric loss. A MMIC signal amplification device is provided for enhanced gain. Ceramic capacitors are provided to increase the reception wavelength of the panel antenna so that it falls within a lower section of the VHF band.

3 Claims, 7 Drawing Sheets

MULTI-DIRECTIONAL PANEL ANTENNA

(a) TECHNICAL FIELD OF THE INVENTION

The present invention generally relates to panel antennas, and more particularly to a panel antenna where its current path covers its circuit board so as to produce multi-directional reception pattern, to increase the signal reception wavelength, and to increase the effective signal reception area.

(b) DESCRIPTION OF THE PRIOR ART

For receiving broadcast television (TV) programs, an outdoor or indoor antenna is a required device. For a conventional indoor antenna, as illustrated in FIG. 1, mainly contains a circuit board 1 having a circuit region 11 in a middle area and reception plates 111 at the lateral sides of the circuit region 1. Both the circuit region 11 and the reception plates 111 are printed on a major side of the circuit board 1. The reception plates 111 are for receiving UHF signals and, for VHF signals, copper strips 112 are provided and connected to the circuit region 11. As described, the conventional antenna has a very simple structure. However, the conventional antenna has to be raised and oriented to aim at the broadcast source, which takes up quite some space and is not quite appealing.

An improved conventional indoor antenna is therefore provided, which contains a two-sided circuit board 2 whose two sides are illustrated in FIGS. 2 and 3, respectively. This conventional antenna mainly utilizes anti-polarization and overlapped coupling to excite magnetic field. Signals are fed to the antenna through a microstrip line 21 and an impedance conversion means. This antenna could achieve multi-direction reception even when laid laterally.

SUMMARY OF THE INVENTION

Therefore, a novel multi-directional panel antenna is provided herein to obviate the foregoing shortcomings of the prior arts. The panel antenna mainly contains a slim box body with a circuit board housed inside. The circuit board is designed so that its current path substantially covers the major surfaces of the circuit board so as to produce multi-directional reception patterns. Pairs of corresponding copper foils and metallic wires are arranged on the circuit board for increasing the effective signal reception area of the panel antenna. An iron-core winding is configured at a feed-in terminal of the panel antenna for impedance matching and signal concentration, and to couple and respond to the current converged in the signal reception layer of the circuit board. A gap is reserved between neighboring copper foils so as to use air to reduce dielectric loss. A signal amplification device is provided in the middle of the circuit board for enhanced gain. Ceramic capacitors are provided to increase the reception wavelength of the panel antenna so that it falls within a lower section of the VHF band. The multi-directional characteristic of the panel antenna relieves a user from the time-consuming burden of orienting the antenna.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
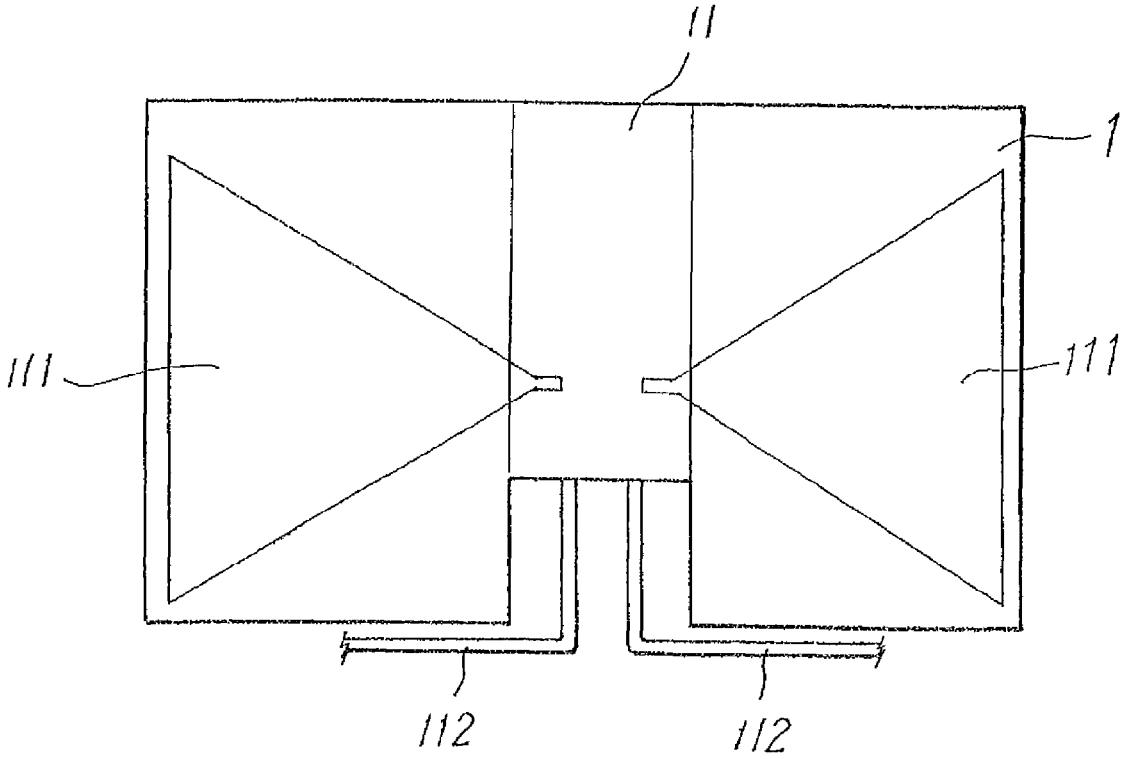
PRIOR ART FIG.1
FIG. 1 is a schematic diagram showing the circuit board of a conventional indoor antenna.
Figure 2:
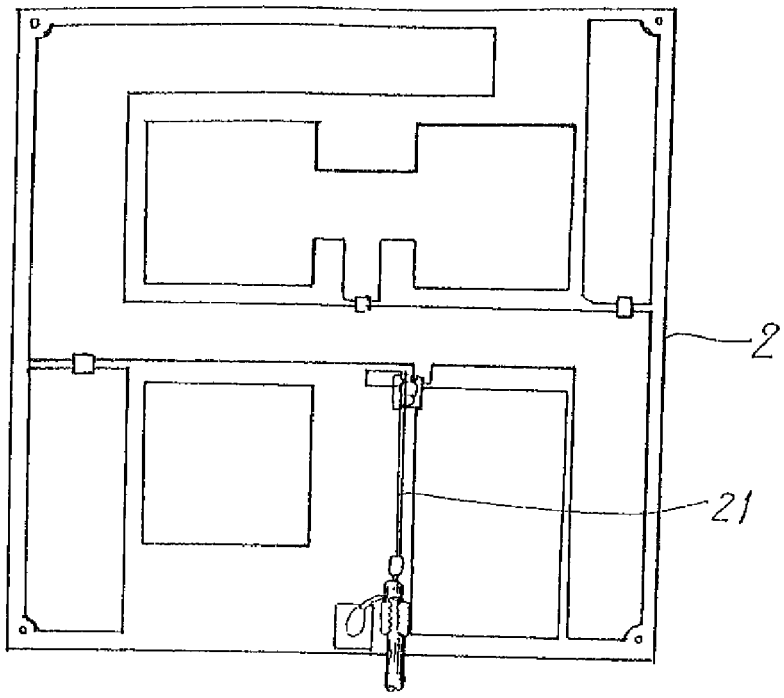
PRIOR ART FIG.2
FIGS. 2 and 3 are schematic diagrams showing the two major sides of the circuit board of another conventional indoor antenna.
Figure 3:
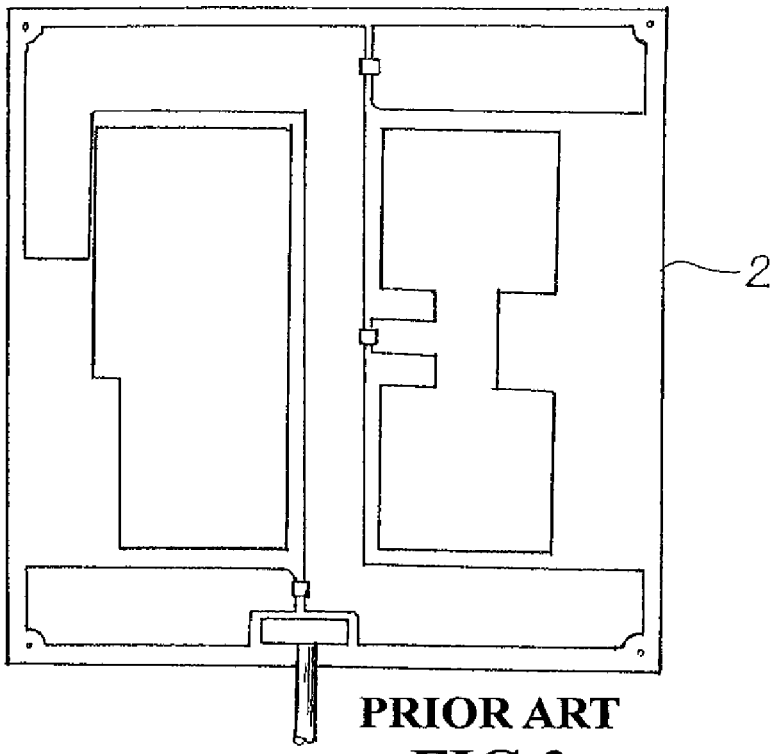
PRIOR ART FIG.3
Figure 4:
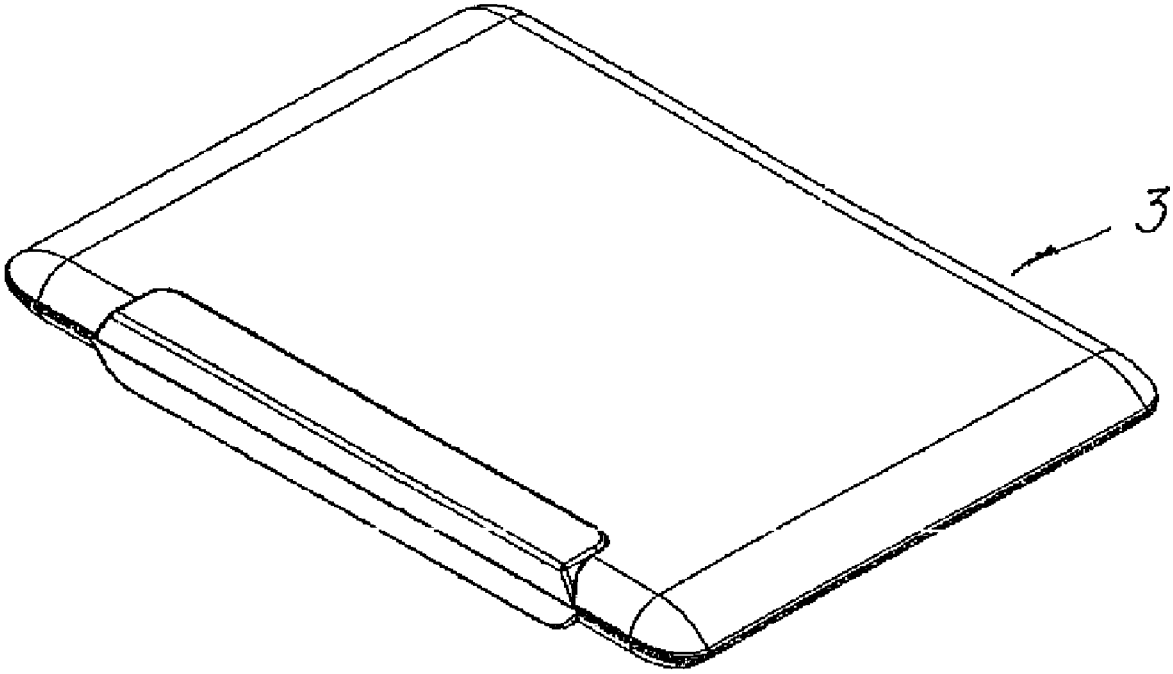
FIG. 4 is a perspective diagram showing the appearance of a panel antenna according to an embodiment of the present invention.
Figure 5:
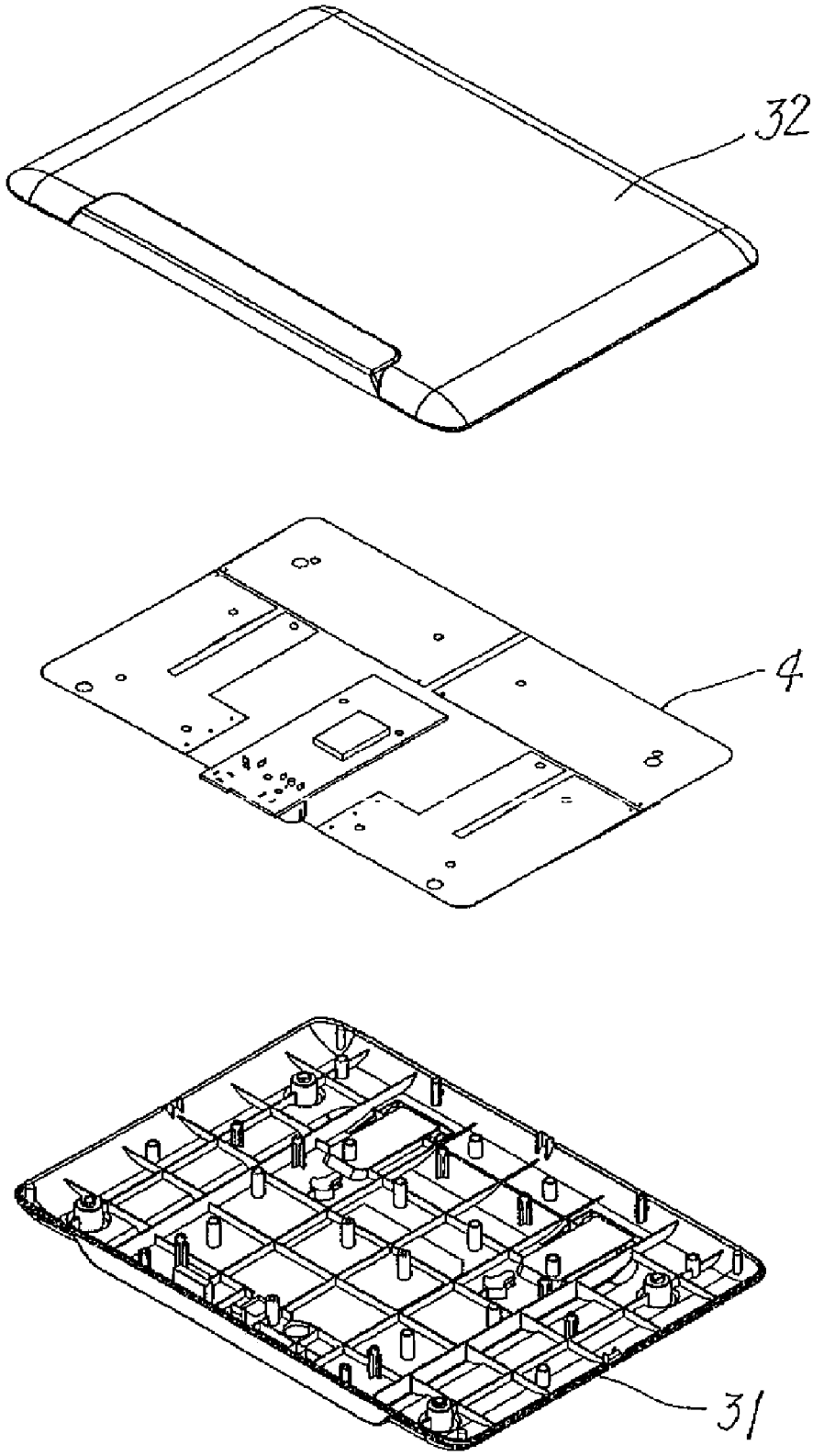
FIG. 5 is a perspective break-down diagram showing the panel antenna of FIG. 4.

As illustrated in FIG. 4, a panel antenna according to an embodiment of the present invention has a slim box body 3 within which a circuit board 4 (as shown in FIG. 5) is housed. Unlike the conventional antenna which has to be oriented to aim at the broadcast signal source, the panel antenna of the present invention could be laid on a table top or hung on a wall surface. The box body 3 is composed of a top piece 32 and a bottom piece 31, which are both of a slim shape. The box body 3 therefore takes up only a limited space and, due to the present invention's multi-directional feature, a user is not burdened with the time-consuming task of orienting the antenna.

Figure 6:
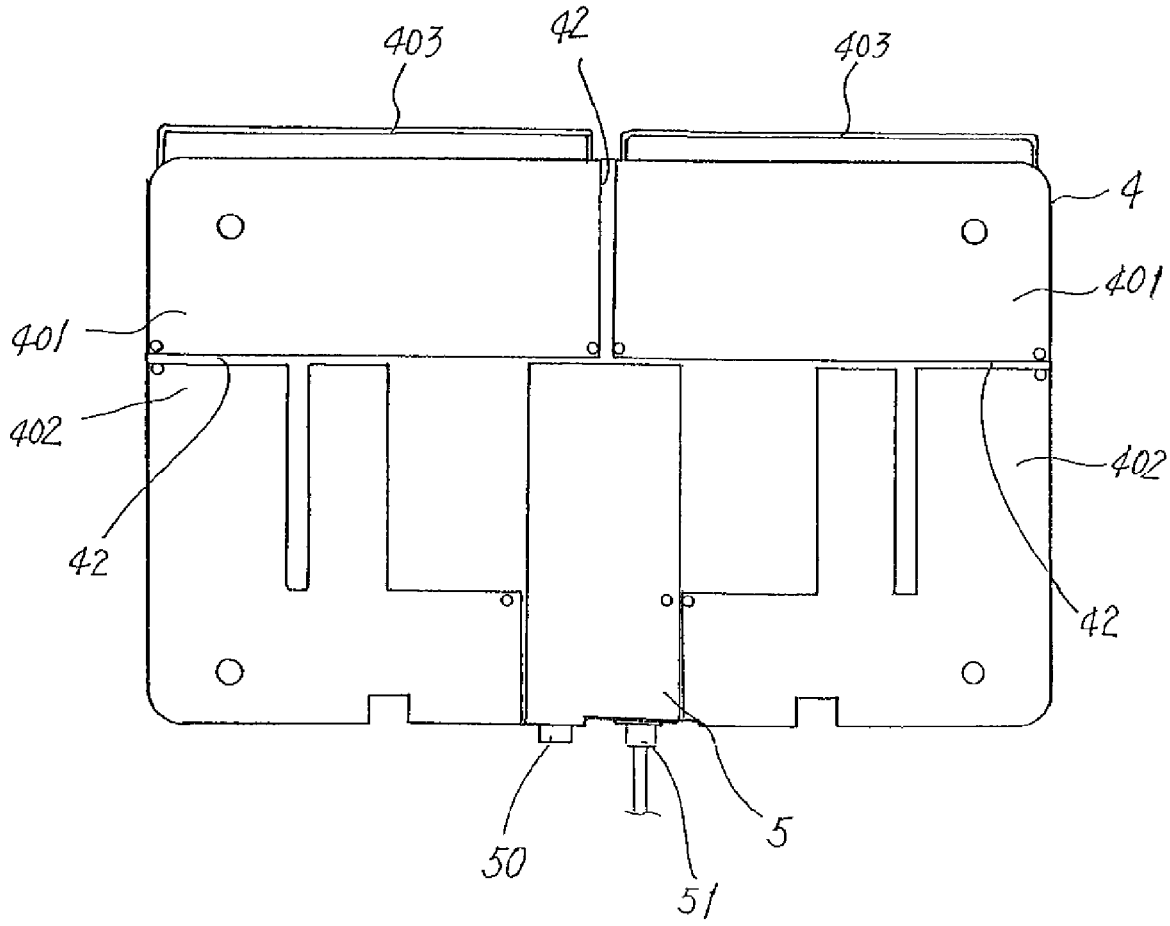
FIG. 6 is a top-view diagram showing the circuit board of the panel antenna of FIG. 5.
Figure 7:
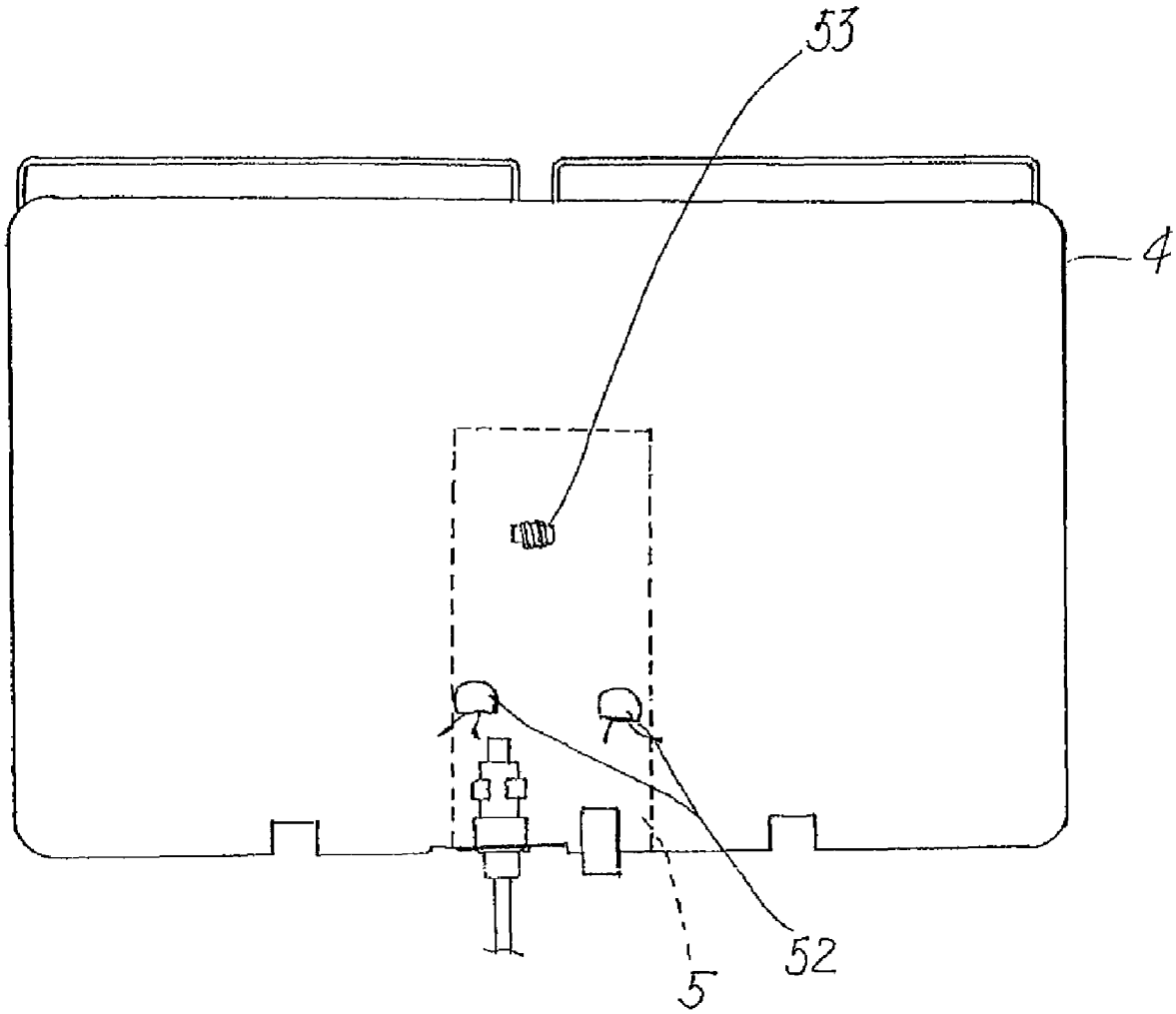
FIG. 7 is a bottom-view diagram showing the circuit board of the panel antenna of FIG. 5.

Please refer to FIG. 6, which shows a top view of the circuit board 4. The design idea of the present invention is to arrange the current path to cover the circuit board 4 so as to produce multi-directional reception patterns. In the middle of the circuit board 4 is a signal amplification device 5 which is a Monolithic Microwave Integrated Circuit (MMIC) for RF signal amplification. Around the lateral sides of the signal amplification device 5 are pairs of corresponding copper foils 401, 402, and metallic wires 403 for increasing the effective signal reception area of the panel antenna. Along a back edge of the signal amplification device 5 are an output terminal 51 and a power socket 50. As shown in FIG. 7, on a bottom side of the circuit board 4, two ceramic capacitors 52 are positioned adjacent to the power socket 50 in a middle area of the circuit board 4. The ceramic capacitors 52 connect the signal amplification device 5 to the antenna so as to form a loop.

An iron-core winding 53 is configured at a feed-in terminal of the antenna whose purpose is for impedance matching and thereby signal concentration. The iron-core winding 53 is able to couple and respond to the current converged in a signal reception layer of the circuit board 4. The copper foils 401 are for the reception of UHF signals while the copper foils 402 are for the reception of VHF signals. A gap 42 is reserved between neighboring copper foils 401 and 402 so that, through inductance and capacitance effects, dielectric loss of the circuit board 4 is reduced by using air as media for enhanced reception of the VHF signal. As mentioned earlier, the ceramic capacitors 52 connect the antenna with the signal amplification device 5 so as to increase the reception wavelength of the panel antenna so that it falls within a lower section of the VHF band. The iron-core winding 53 itself is capable of impedance conversion, in contrast to the prior arts where impedance conversion is separately performed after signal is introduced through a microstrip line.

The signal amplification device 5 is a MMIC for amplifying RF signals. It is positioned within a back region in the middle of the circuit board 4. The received signal is amplified by the signal amplification device 5 which provides the required gain in a poor-reception region.

Figure 8:
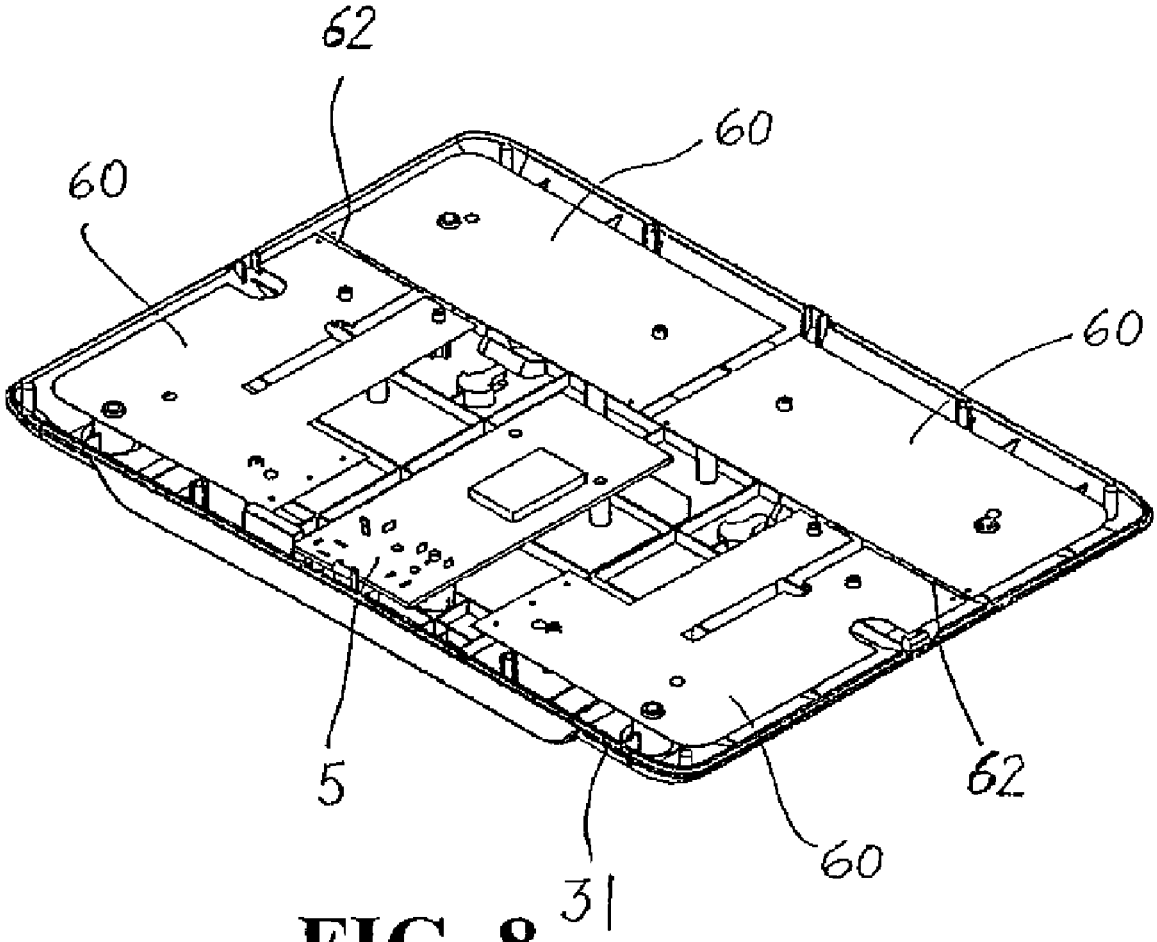
FIG. 8 is a perspective diagram showing the bottom piece of a panel antenna according to another embodiment of the present invention.

In an alternative embodiment of the present invention shown in FIG. 8, the circuit board 4 is replaced by metallic plates such as tinplates. As illustrated, a number of reception pieces 60 of tinplates of different sizes are arranged on the bottom piece 31. The signal amplification device 5 within a back region in the middle of the bottom piece 31. A gap 62 is reserved between neighboring reception pieces 60 so that dielectric loss is reduced by using air as media on one hand and the effective signal reception area is increased on the other hand. The reception quality of the antenna is therefore enhanced.

In yet another embodiment of the present invention where the antenna is designed for use under normal signal coverage, as there is no need for signal amplification, the signal amplification device 5 could be omitted for a reduced production cost.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A multi-directional panel antenna, comprising a slim box body and a circuit board housed inside said box body; wherein said circuit board comprises:

a signal amplification device in the middle of a top side of said circuit board;

copper foils and metallic wires covering said top side other than said signal amplification device and covering a bottom side of said circuit board;

said copper foils configured into shapes for receiving VHF and UHF signals, respectively;

a gap reserved between neighboring copper foils so as to use air to reduce dielectric loss;

an iron-core winding at a feed-in terminal for impedance matching and to couple and respond to the current converged in a signal reception layer of said circuit board; and a plurality of ceramic capacitors connected to said signal amplification device to increase the signal reception wavelength so as to cover a lower section of VHF band.

2. A multi-directional panel antenna, comprising a slim box body and a metallic plate housed inside said box body; wherein said metallic plate comprises:

a signal amplification device in the middle of a top side of said metallic plate;

copper foils and metallic wires covering said top side other than said signal amplification device and covering a bottom side of said metallic plate;

said copper foils configured into shapes for receiving VHF and UHF signals, respectively;

a gap reserved between neighboring copper foils so as to use air to reduce dielectric loss;

an iron-core winding at a feed-in terminal for impedance matching and to couple and respond to the current converged in a signal reception layer of said metallic plate; and a plurality of ceramic capacitors connected to said signal amplification device to increase the signal reception wavelength so as to cover a lower section of VHF band.

3. A multi-directional panel antenna, comprising a slim box body and a circuit board housed inside said box body; wherein said circuit board comprises:

copper foils and metallic wires covering a top side and a bottom side of said circuit board;

said copper foils configured into shapes for receiving VHF and UHF signals, respectively;

a gap reserved between neighboring copper foils so as to use air to reduce dielectric loss;

an iron-core winding at a feed-in terminal for impedance matching and to couple and respond to the current converged in a signal reception layer of said circuit board; and a plurality of ceramic capacitors for increasing the signal reception wavelength so as to cover a lower section of VHF band.

* * * * *